US007063184B1

(12) United States Patent
Johnson

(10) Patent No.: US 7,063,184 B1
(45) Date of Patent: Jun. 20, 2006

(54) SOUND REDUCING PANEL

(76) Inventor: Lahnie Johnson, 4216 E. Busch Blvd., Tampa, FL (US) 33617

( * ) Notice: Subject to any disclaimer, the term of this patent is extended or adjusted under 35 U.S.C. 154(b) by 48 days.

(21) Appl. No.: 10/458,983

(22) Filed: Jun. 11, 2003

Related U.S. Application Data

(60) Provisional application No. 60/388,438, filed on Jun. 12, 2002.

(51) Int. Cl.
*E04B 1/99* (2006.01)
*E04B 2/02* (2006.01)
*G10K 11/16* (2006.01)

(52) U.S. Cl. ..... 181/290; 181/291; 181/210; 52/145

(58) Field of Classification Search ..... 181/290, 181/291, 293–296, 286–288, 284, 210; 52/144, 52/145
See application file for complete search history.

(56) References Cited

U.S. PATENT DOCUMENTS

| | | | | | |
|---|---|---|---|---|---|
| 2,495,636 | A | | 1/1950 | Hoeltzel et al. | |
| 2,497,912 | A | | 2/1950 | Rees | |
| 2,553,363 | A | | 5/1951 | Droeger | |
| 2,694,025 | A | | 11/1954 | Slayter et al. | |
| 2,923,372 | A | | 2/1960 | Maccaferri | |
| 3,136,397 | A | | 6/1964 | Eckel | |
| 3,713,474 | A | * | 1/1973 | Orlando | 181/287 |
| 3,748,799 | A | * | 7/1973 | Tough et al. | 52/144 |
| 3,934,382 | A | * | 1/1976 | Gartung | 52/144 |
| 3,948,347 | A | * | 4/1976 | Rutledge | 181/291 |
| 3,949,827 | A | | 4/1976 | Witherspoon | |
| 3,967,693 | A | | 7/1976 | Okawa | |
| 3,971,867 | A | * | 7/1976 | Randall | 181/290 |
| 4,016,689 | A | * | 4/1977 | Wendt | 52/145 |
| 4,113,053 | A | | 9/1978 | Matsumoto et al. | |
| 4,146,999 | A | * | 4/1979 | Petrovec et al. | 52/145 |
| 4,160,491 | A | | 7/1979 | Matsumoto et al. | |
| 4,194,329 | A | * | 3/1980 | Wendt | 52/145 |
| 4,207,964 | A | | 6/1980 | Taguchi | |
| 4,213,516 | A | * | 7/1980 | Sulewsky | 181/286 |
| 4,214,646 | A | * | 7/1980 | Planes et al. | 181/287 |
| 4,248,325 | A | | 2/1981 | Georgopoulos | |
| 4,276,954 | A | * | 7/1981 | Romano | 181/224 |
| 4,306,631 | A | | 12/1981 | Reusser | |
| 4,402,384 | A | | 9/1983 | Smith et al. | |
| 4,605,090 | A | | 8/1986 | Melfi | |
| 4,607,466 | A | | 8/1986 | Allred | |
| 4,805,734 | A | | 2/1989 | Mast | |
| 4,834,213 | A | | 5/1989 | Yamamoto et al. | |
| 5,020,632 | A | * | 6/1991 | Nelson | 181/290 |
| 5,217,771 | A | | 6/1993 | Schmanski et al. | |
| 5,272,284 | A | | 12/1993 | Schmanski | |
| 5,644,872 | A | * | 7/1997 | Perdue | 52/144 |
| 6,158,176 | A | * | 12/2000 | Perdue | 52/144 |
| 6,321,871 | B1 | * | 11/2001 | Russell | 181/295 |
| 6,443,258 | B1 | * | 9/2002 | Putt et al. | 181/294 |
| 6,698,543 | B1 | * | 3/2004 | Golterman | 181/291 |
| 6,776,258 | B1 | * | 8/2004 | Grosskrueger et al. | 181/294 |

FOREIGN PATENT DOCUMENTS

| | | | |
|---|---|---|---|
| DE | 3402967 | A1 * | 8/1985 |
| GB | 2236379 | A * | 4/1991 |
| JP | 06033425 | A * | 2/1994 |

* cited by examiner

*Primary Examiner*—Edgardo San Martin
(74) *Attorney, Agent, or Firm*—Frijouf, Rust & Pyle, P.A.

(57) ABSTRACT

An apparatus and method of making an improved sound reducing panel is disclosed suitable for use in an outdoor or a hazardous environment. The improved sound reducing panel comprises a water resistant sound absorbing member with a porous covering sheet overlaying a face surface of the sound absorbing member. A support frame is disposed about an outer perimeter of the sound absorbing member. An attachment secures the improved sound reducing panel to the support frame. In one embodiment, a sound blocking member is located adjacent to the sound absorbing member.

5 Claims, 10 Drawing Sheets

SOUND REDUCING PANEL

CROSS-REFERENCE TO RELATED APPLICATIONS

This application claims benefit of U.S. Patent Provisional application Ser. No. 60/388,438 filed Jun. 12, 2002. All subject matter set forth in provisional application Ser. No. 60/388,438 is hereby incorporated by reference into the present application as if fully set forth herein.

BACKGROUND OF THE INVENTION

1. Field of the Invention

This invention relates to sound reduction and more particularly to an improved sound reduction panel suitable for use in an outdoor and/or a hostile environment.

2. Background of the Invention

The prior art has known various types of devices and methods for reducing the level of sound within an environment. The various types of devices and methods of the prior art for reducing the level of sound within an environment included a diverse and variety of apparatuses and methods adapted for many as specific applications and uses.

One particular type of device for reducing the level of sound within an environment comprises the use of sound reducing panels and/or sound absorbing devices. Various types of sound reducing panels and sound absorbing devices have been incorporated by the prior art to reduce the level of sound and/or to selectively reduce or inhibit reflection of sound from reflective surfaces within an environment.

In some instances, the apparatuses and methods for reducing the level of sound within an environment selectively reduced the level of sound within an environment. Many of the apparatuses and methods for reducing the level of sound within an environment were specifically designed for providing enhancements for improving the acoustics within the environment, sound reducing panels and sound absorbing devices have been employed in very large rooms such as auditoriums as well as smaller rooms such as recording studios, home theaters and the like.

Other apparatuses and methods for reducing the level of sound within an environment of the prior art reduce the overall level of acoustic noise and/or sound and/or noise within the environment. In many cases, sound absorbing apparatuses and methods were used to reduce the sound of operating machinery as well as being used for reducing the transmission of sound and/or noise between the adjacent walls of a building.

The following U.S. Patents are representative of the attempts of the prior art to provide apparatuses and devices for reducing sound within an environment.

U.S. Pat. No. 2,495,636 to O. R. Hoeltzel et al. discloses a unit comprising a layer of loosely matted mass of fibrous material. A substantially impervious preformed and film of thermoplastic synthetic resin material is integralized with the fibers in one face of the loosely matted material. A fabric covering on the other face of the loosely matted layer is enfolded and is secured about the edges of the mass and the film. The mass, film and fabric are in the form of the sound proof flexible panel adapted to cover and soundproof a section of a wall.

U.S. Pat. No. 2,497,912 to W. M. Rees discloses an acoustic construction for the walls and ceilings of an enclosure comprising a sound absorbing layer overlying the wall and formed by a plurality of rectangles or tiles of fibrous material arranged in a plane. The edge of each of the tiles are contiguous to and slightly spaced from the edges of adjoining tiles. A renewable facing for the sound absorbing layer includes a plurality of thin sheets of porous material individual to the tiles. Each of the sheets having tabs at its edges integral with the sheets and resiliently held in place between adjacent edges of the tiles to hold the sheets in place over the face of the tiles.

U.S. Pat. No. 2,553,363 to C. C. Droeger discloses a non-combustible wall or ceiling of a plurality of parallel, latterly spaced, non-combustible primary furrings anchored thereon. Sound absorbent pads are arranged between adjacent pairs of furrings. A plurality of spaced, non-combustible secondary furrings extend extended transversely across the primary furrings and are secured thereto. Each of the secondary furrings comprise a portion lying in a plane parallel with the wall or ceiling and bridging between primary furrings and are provided with a multiplicity of perforations adapted to threadably receive threaded shanks of screws. A multi-perforate finish sheaths overlies the aforesaid parts.

U.S. Pat. No. 2,694,025 to G. Slayter et al. discloses a structural board comprising a core of glass fibers bounded into a porous self-sufficient layer. A layer of substantially inorganic cementitious material is integrated with at least one of the faces of the core. The cementitious layer is formed of a composition consisting essentially of an amide-aldehyde resin selected from the group consisting of urea formaldehyde and melamine formaldehyde and gypsum cement.

U.S. Pat. No. 2,923,372 to M. Maccaferri discloses an all plastic acoustic tile formed of a molded plastic material comprising a plate-like body having a rearwardly extending edge flange thereabout integral therewith. The body is formed to provide the front side thereof as a flat, planar face and having a multiplicity of apertures therethrough from the front face to and opening through the rear side all the body. Sound wave dampening tubes are molded integrally with the body projecting rearwardly from the rear side thereof. Each of the dampening tubes has a passage therethrough opening at the rear end thereof Each of the dampening tubes is located on the rear side of the body in position with a body aperture opening into and forming the inlet to the passage of the dampening tube. The body has the rear side thereof formed with an annular recess therein about each of the dampening tubes providing a reduced thickness base portion of the body with which the tube is integrally joined.

U.S. Pat. No. 3,136,397 to O. C. Eckel discloses an assembly with two angular adjoining walls and a ceiling. The assembly comprises a plurality of panels with a first of the panels extending along the ceiling from the first wall. A second of the panels extends along the first wall below the ceiling panel. A Z-shaped retainer embodying one angular portion is attached to the first wall. Another angular portion extends laterally away from the wall indirectly below the first ceiling panel and above the second panel. And a third angular portion extends downwardly away from the ceiling panel. The ceiling first panel rests on the other angular portion of the retainer.

U.S. Pat. No. 3,949,827 to Witherspoon discloses an acoustical panel assembly having improved structural, decorative and acoustical properties. The panel assembly includes a perimeter frame. A thin septum member is supported in the center of the frame. A fibrous glass layer is positioned adjacent each side of the septum member. A molded, semi-rigid, fibrous glass diffuser member is positioned adjacent each of the fibrous glass layers. The assembly includes means for joining adjacent panel assemblies and, in one embodiment, an outer decorative fabric layer is positioned adjacent each of the outer surfaces of the diff-user members.

U.S. Pat. No. 3,967,693 to Okawa discloses a means and method for diminishing energy of sound. A corrugated cover having holes therethrough is mounted on a wall by ribs and an edge plate. The wall and edge plate together with the ribs and corrugated cover form a plurality of chambers, each cooperating with a plurality of the holes for diminishing the energy of impinging sound waves.

U.S. Pat. No. 4,113,053 to Matsumoto et al. discloses a sound absorbing body which can effectively be utilized as an exterior sound absorbing wall or an interior wall of a house. The sound absorbing body comprises a number of sound absorbing cavities inclined at an angle alpha which is smaller than 80 degrees with respect to a transverse horizontal sectional plane of the body. The sound absorbing cavities being opened at the sound incident surface.

U.S. Pat. No. 4,160,491 to Matsumoto et al. discloses a perlite sound absorbing plate and a sound insulating wall constructed by arranging a number of the plates side by side and by assembling together into one integral body. The plate is composed of a mixture including 1,000 cubic centimeters by bulk volume of formed perlite particles each having a diameter of 0.1 to 7.0 millimeters 100 to 140 grams of cement, liquid rubber latex containing 5 to 20 grams of solid ingredients and a suitable amount of water and produced by press molding with a compression ratio of 1.10 to 1.30. The wall is constructed by assembling a number of the plates each provided with a side groove with the aid of supporting columns and reinforcing plates, each having a ridge adapted to be engaged with the side groove of the plate.

U.S. Pat. No. 4,207,964 to Taguchi discloses a sound absorbing and diffusing unit provided for assembling an acoustic screen which can be placed or hung in front of a wall inside an acoustic room for improving a sound-effect therein. These units are detachably joined together with each other so that they may be easily separated and assembled again to form an acoustic screen having another shape or construction to adjust or modulate a sound-effect. A sound absorbing porous panel having a desired picture or pattern can be easily hung against a wall. The decorative panel can be reversely hung on the wall to provide another interior ornamentation. Accordingly, an acoustically correct room and a desired ornamentation on a wall inside the acoustic room can be easily obtained and changed without providing a rigid reverberating surface of the room.

U.S. Pat. No. 4,248,325 to Georgopoulos discloses an improved sound absorptive tackable space dividing wall panel or similar article in which a wire mesh screen is disposed within the sound absorptive material a distance from the tackable surface less than the length of the tack pin, thereby providing additional support for the tackable load without appreciably reducing the sound absorptive characteristics of the panel.

U.S. Pat. No. 4,306,631 to Reusser discloses a noise barrier or other type wall or building assembly including a plurality of spans each extending between spaced apart posts and having top and bottom girts affixed to the posts and in turn supporting a plurality or series of vertically disposed panels. Unique mating interlock elements integrally formed along both lateral edges of the wall or building exterior panels allow the sequential interconnection of all panels in a series by means of a rotating displacement of the individual panels to yield multilateral interlocking of the panels. The panel faces are configured to provide shadow texture, while masking of the posts and top girts in a free-standing type wall is obtained by a split cover assembly and split cap trim, respectively.

U.S. Pat. No. 4,402,384 to Smith et al. discloses a sound barrier system particularly suited for out-of-doors, ground-mounted installations, such as for a highway noise barrier comprising a vertical wall composed of successive individual wall sections arranged with immediately adjacent wall sections disposed at an intersecting angle to each other. Immediately adjacent wall sections are rigidly joined together in abutment along a common vertical joint. An earth anchor is anchored into the ground at each vertical joint. Each joint is secured to the corresponding earth anchor so that downwardly directed hold-down forces are applied by the earth anchors to the wall at the bottom portions of the joints.

U.S. Pat. No. 4,605,090 to Melfi discloses a post and panel type noise barrier fence formed of a plurality of concrete vertical posts or columns which have grooves to hold flat concrete panels between successive ones of the columns. The panels can have a stepped lower edge to accommodate elevational changes in the terrain. Also, certain of the columns have oppositely disposed recesses angled from each other so as to accommodate directional changes at the columns in the direction of the barrier fence.

U.S. Pat. No. 4,607,466 to Allred discloses an acoustic panel having a porous layer and a generally rigid layer affixed to each other. The generally rigid layer includes at least one passageway opening on one side of the rigid layer and extending through the rigid layer to the porous layer. The porous layer is a fibrous material. The rigid layer is a concrete-type material, such as vermiculite-cement plaster. This acoustic panel further comprises a generally rigid planar surface positioned adjacent to the porous layer. This generally rigid planar surface can comprise an insulating layer affixed to the other side of the porous layer and a structural layer fastened to the insulating layer. The insulating layer is a polyurethane foam board. The structural layer is a particle board.

U.S. Pat. No. 4,805,734 to Mast discloses an acoustic wall for streets and parks and for garden-like designs consisting of several substantially U-shaped frame members arranged at a distance from one another, which frame members are connected among one another and have mats applied on their front and side surfaces. In order to substantially reduce the manufacture on location, the duration of setting up and the greening time on location, the acoustic wall consists of individual elements of which each has several U-shaped frame members which are secured at the ends of their long legs on a base. The base forms a rigid frame with fastening means for a lift for the lifting and transporting of the acoustic wall. One or several narrow-mesh mats are secured on the base, which mats prevent a falling out of material filled into the acoustic wall during transport.

U.S. Pat. No. 4,834,213 to Yamamoto et al. discloses a noise silencer for highways adapted to be stuffed in a joint gap formed in a highway. It has a rectangular casing and padding enclosed in the casing. The casing is provided with a vent hole adapted to be closed by a plug. Before mounting the noise silencer, air is firstly sucked out from the silencer through the vent hole to flatten the padding and the vent hole is plugged. After the silencer has been mounted, the vent hole is open to inflate the padding so that the silencer will be pressed against the opposite walls of the joint gap.

U.S. Pat. No. 5,217,771 to Schmanski et al. discloses a device for preventing the transmission of sound, the device being fabricated of polymer composition and comprising a hollow core member formed of fiber-reinforced thermosetting resin, and at least an outer member formed of unreinforced thermoplastic resin which is friction fit to the core member. The core member and outer members are preferably formed by pultrusion and extrusion, respectively. Adjacently disposed devices are connected together to form a fence-like barrier through which few or no sound waves arc allowed to pass. This system is advantageously used to prevent sound waves emanating from a large transportation structure such as a highway, railroad track, or airport.

U.S. Pat. No. 5,272,284 to Schmanski discloses a sound wall for placement along a roadside for reducing the transmission of sound from a traffic area wherein the sound wall comprises a plurality of stiff, resilient containment members respectfully configured with the channel configuration and having an enclosed channel volume and continuous open side. Each channel volume is filled with a composite composition of rubber chips and binder compressed within the channel and substantially filling the channel volume. These containment members are stacked in nesting relationship to form a wall structure, with the open side being oriented toward the traffic area.

Although the aforementioned apparatuses and methods for reducing the level of sound have been utilized in the art for reducing sound and/or noise, and for enhancing the acoustic characteristics and environment many these apparatus and methods devices were specifically designed for indoor use. These apparatuses and methods were not adaptable for use in an outdoor or hostile environment.

The apparatuses and methods of the prior art that have been used for reducing the level of sound or noise in an outdoor environment having generally been large permanent structures such as fabricated walls and the like. In the alternative, natural plants have been used in the prior art for reducing levels of sound and noise in an outdoor environment. Natural foliage such as hedges, shrubs and the like have been used by the prior art for reducing and/or disbursing sound and/or noise in an outdoor environment.

Accordingly, there is a need in the art for a simple reliable and efficient apparatus for reducing sound and/or noise in an outdoor or hostile environment.

Therefore, it is an object of the present invention to provide an improved sound reducing panel suitable for use in an outdoor or hostile environment which is likely efficient and provides significant sound absorption.

Another object of this invention is to provide an improved sound reducing panel which is capable of withstanding the rigors of an outdoor or a hostile or harsh environment.

Another object of this invention is to provide an improved sound reducing panel that capable of withstanding the weather and abuse of an outdoor and/or hostile environment.

Another object of this invention is to provide an improved sound reducing panel that incorporates a support frame for mounting the improved sound reducing panel.

Another object of this invention is to provide an improved sound reducing panel that may be readily erected and removed from an outdoor and/or hostile environment.

The foregoing has outlined some of the more pertinent objects of the present invention. These objects should be construed as being merely illustrative of some of the more prominent features and applications of the invention. Many other beneficial results can be obtained modifying the invention with in the scope of the invention. Accordingly other objects in a full understanding of the invention may be had by referring to the summary of the invention and the detailed description describing the preferred embodiment of the invention.

SUMMARY OF THE INVENTION

A specific embodiment of the present invention is shown in the attached drawings. For the purpose of summarizing the invention, the invention relates to an improved sound reducing panel suitable for use in an outdoor or a hazardous environment comprising a water resistant sound absorbing member defined by a first and second face surface and a plurality of peripheral edges. A porous covering sheet overlies the first and second face surfaces of the sound absorbing member. A support frame is located about the plurality of peripheral edges of the sound absorbing member. A mounting is provided for supporting the improved sound reducing panel.

In one embodiment of the invention, the sound absorbing member is substantially rigid sheet of sound absorbing material. In another embodiment of the invention, the sound absorbing member is substantially flexible sheet of sound absorbing material.

The porous covering sheet may be substantially flexible and may comprises a first and a second covering sheet for overlaying the first and second face surfaces of the sound absorbing member. Preferably, an attachment comprising an adhesive secures the porous covering sheet to the sound absorbing member.

In one embodiment of the invention, the support frame comprises an internal frame located about the plurality of peripheral edges of the sound absorbing member. The internal frame may includes a water resistant curable polymeric material impregnated into a portion of each of the plurality of peripheral edges of the sound absorbing member.

In another embodiment of the invention, the support frame comprises an external frame located about the plurality of peripheral edges of the sound absorbing member. The external frame may comprise a rigid material overlying a portion of each of the plurality of peripheral edges of the sound absorbing member.

In another embodiment of the invention, the improved sound reducing panel includes a water resistant sound blocking member affixed to the water resistant sound absorbing member for blocking the transmission of sound through the sound reducing panel. The porous covering sheet overlaying the first and second face surfaces of the sound absorbing member and the water resistant sound blocking member.

The invention is also incorporated into the method of forming a sound reducing panel, comprising the steps of immersing each of the peripheral edges of a sheet of sound reducing material into a water resistant material to form an internal frame. The first and second faces of the sound absorbing member are covered with the covering sheet. The covering sheet is affixed to sound reducing material.

The foregoing has outlined rather broadly the more pertinent and important features of the present invention in order that the detailed description that follows may be better understood so that the present contribution to the art can be more fully appreciated. Additional features of the invention will be described hereinafter which form the subject matter of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
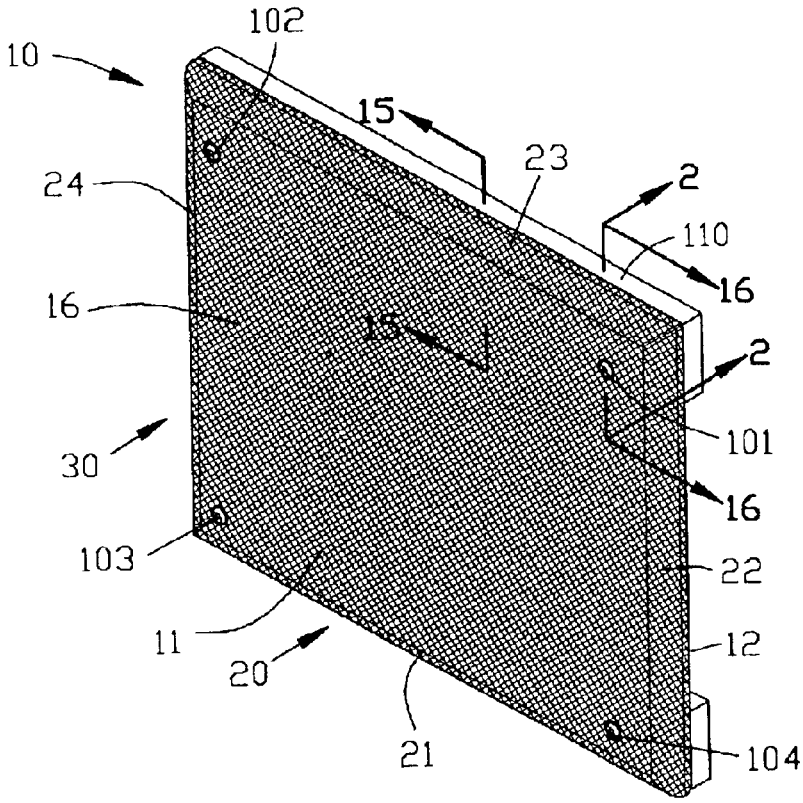
FIG. 1 is an isometric view of a first embodiment of an improved sound reducing panel of the present invention installed on a support in an outdoor or a hazardous environment.

FIG. 1 is an isometric view of a first embodiment of an improved sound reducing panel 10 of the present invention installed in an outdoor or a hazardous environment. The improved sound reducing panel 10 comprises a first and a second face surface 11 and 12. Each of the first and second face surfaces 11 and 12 includes a multiplicity of pores 16 for receiving sound and/or noise from the environment.

The improved sound reducing panel 10 comprises a plurality of peripheral edges 20 shown as peripheral edges 21–24. Although the improved sound reducing panel 10 has been shown as having a rectangular configuration with four peripheral edges 21–24, it should be understood that the improved sound reducing panel 10 may have configurations different than a rectangular configuration.

Figure 2:
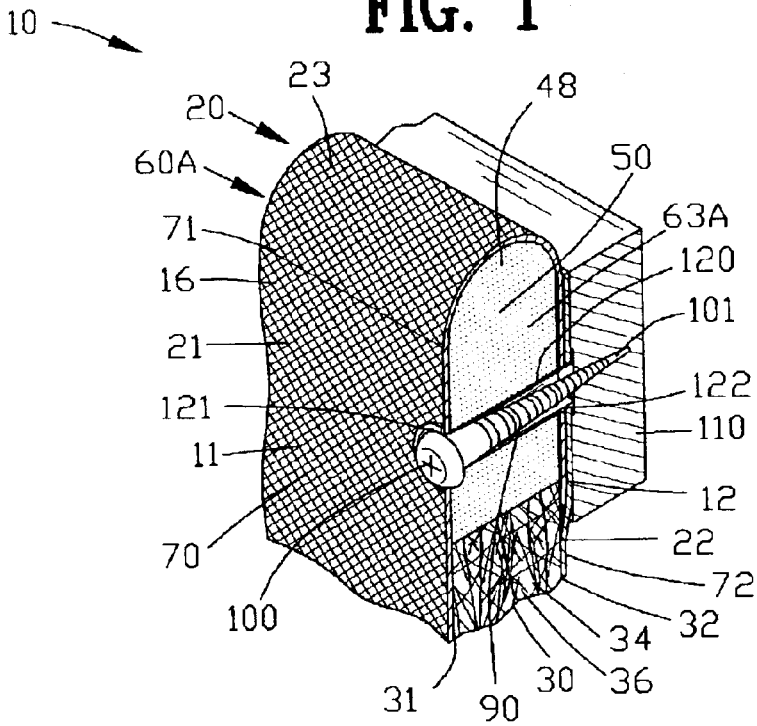
FIG. 2 is an enlarged isometric view along line 2—2 in FIG. 1.

FIG. 2 is an enlarged isometric sectional view along line 2—2 in FIG. 1. The improved sound reducing panel 10 comprises a water resistant sound absorbing member 30 comprises a first and a second face surface 31 and 32. The improved sound reducing panel 10 is formed from a multiplicity of fibers 34 defining a multiplicity of pores 36 between adjacent fibers 34. The multiplicity of fibers 34 enables the sound and/or noise to enter through the multiplicity of pores 36 and to be dispersed by the multiplicity of fibers 34 within the water resistant sound absorbing member 30. In one example of the invention, the water resistant sound absorbing member 30 is formed from one to two inch thick fiber glass fiber board having a density of 6 pounds per square foot.

Figure 3:
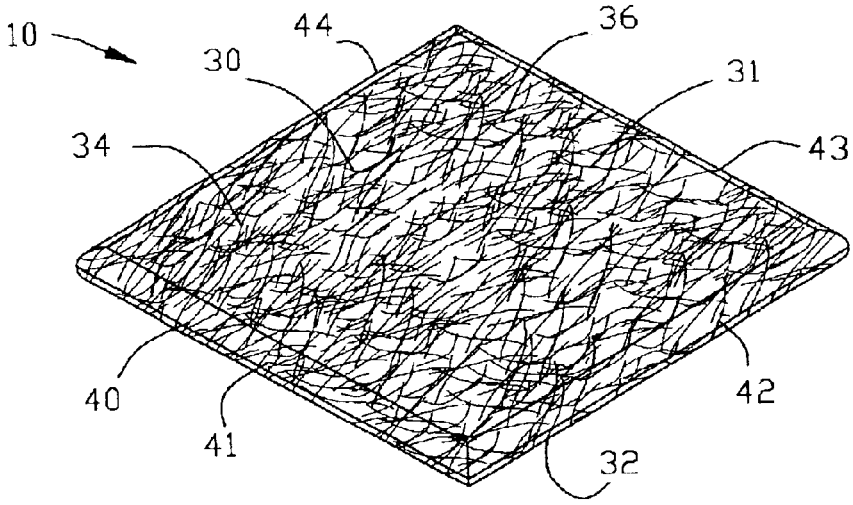
FIG. 3 is a top isometric view of water resistant sound absorbing member for forming the improved sound reducing panel of the present invention that suitable for use in an outdoor or a hazardous environment.
Figure 4:
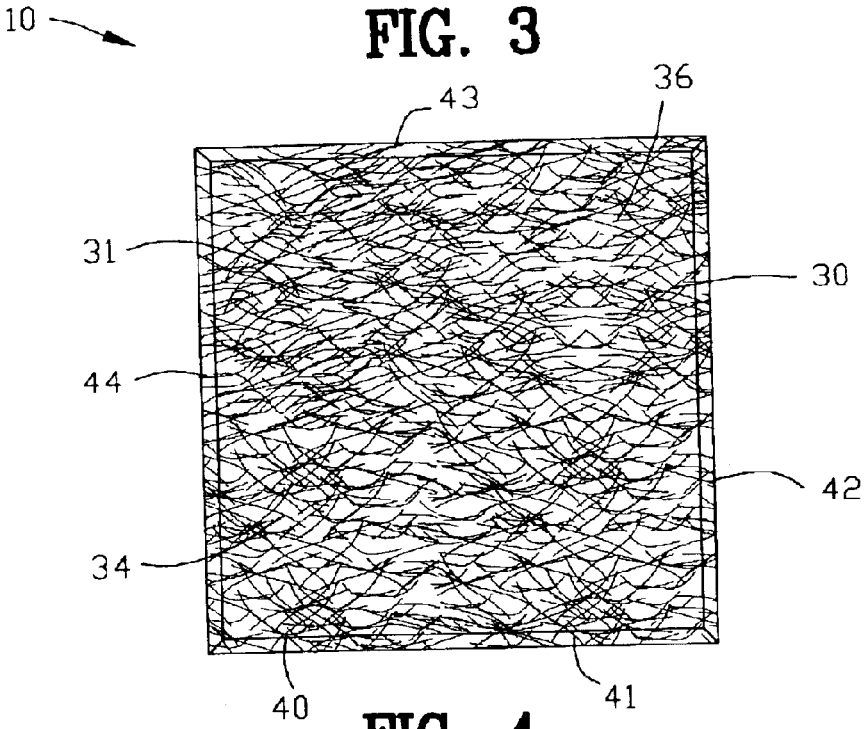
FIG. 4 is a top view of FIG. 3.
Figure 5:
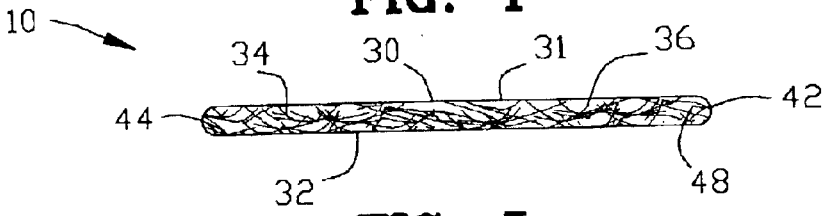
FIG. 5 is a side view of FIG. 4.

FIGS. 3–5 are various views of the water resistant sound absorbing member 30 of the present invention. The water resistant sound absorbing member 30 comprises the first and second face surfaces 31 and 32.

In this example the water resistant sound absorbing member 30 comprises a plurality of peripheral edges 40 shown as peripheral edges 41–44 in a rectangular configuration. In this first embodiment of the invention, each of the plurality of peripheral edge 41–44 has a substantially rounded cross-section 48. Although the water resistant sound absorbing member 30 has been shown in a rectangular configuration, it should be understood that the improved sound reducing panel 10 may have numerous other configurations.

In one example of the invention, the water resistant sound absorbing member 30 is formed from a substantially rigid sheet of sound absorbing material. In the alternative, the water resistant sound absorbing member 30 may comprise a substantially flexible sheet of sound absorbing material.

FIGS. 6–11 illustrate various steps in the process of making the improved sound reducing panel 10 of the present invention. A support frame 60 supports the flexible sheet of sound absorbing material. Preferably, the support frame 60 is located about the plurality of peripheral edges 40 of the water resistant sound absorbing member 30. The support frame 60 may comprises an internal frame or an external frame or a combination thereof In the first embodiment of the invention, the support frame 60 comprises an internal frame 60A extending about the peripheral edges 41–44 of the water resistant sound absorbing member 30. The internal frame 60A comprises a curable polymeric material 50 to add rigidity to the improved sound reducing panel 10.

The curable polymeric material 50 comprises a water resistant curable polymeric material 50 impregnated into a portion of each of the plurality of peripheral edges 41–44 of the sound absorbing member 30. In this example of the invention, the internal frame 60A comprises a first through fourth frame portion 61A–64A for providing rigidity to the water resistant sound absorbing member 30. In one example of the invention, the water resistant curable polymeric material 50 comprises a two part fiber glass resin curable polymeric material.

Figure 6:
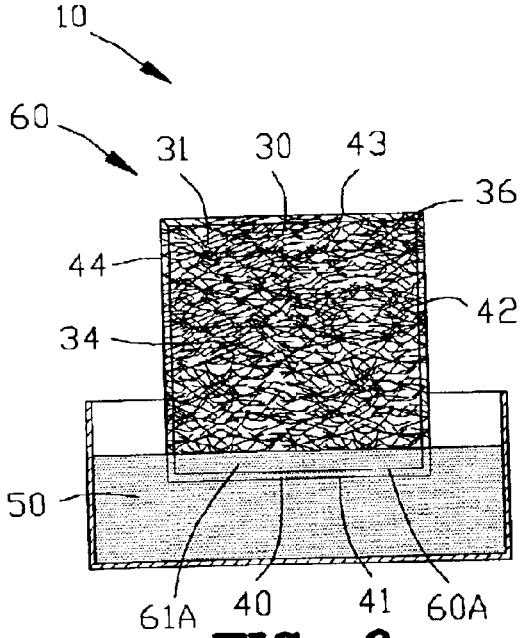
FIG. 6 illustrates a first step of making the first embodiment of the improved sound reducing panel depicting the immersion of a first edge of a sound absorbing member into a water resistant curable polymeric material to form an internal frame.

FIG. 6 illustrates a first step of making the improved sound reducing panel 10 of the present invention depicting the immersion of a first edge 41 of the sound absorbing member 30 into a water resistant curable polymeric material 50 to form the first frame portion 61A of the internal frame 60A.

Figure 7:
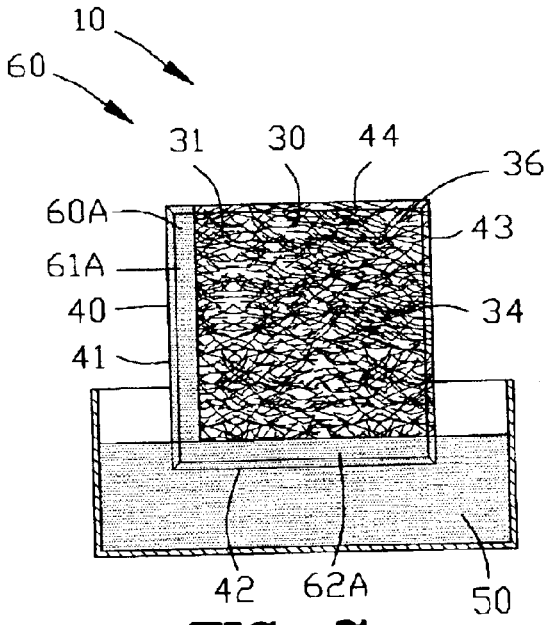
FIG. 7 illustrates a second step of making the first embodiment of the improved sound reducing panel of FIGS. 1 and 2 depicting the immersion of a second edge of a sound absorbing member into the water resistant curable polymeric material.

FIG. 7 illustrates a second step of making the improved sound reducing panel 10 depicting the immersion of the second edge 42 of a sound absorbing member 30 into the water resistant curable polymeric material 50 to form the second frame portion 62A of the internal frame 60A.

Figure 8:
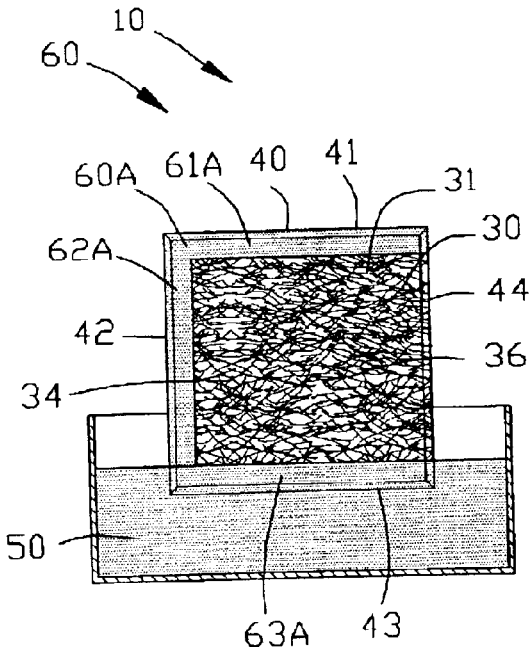
FIG. 8 illustrates a third step of making the first embodiment of the improved sound reducing panel of FIGS. 1 and 2 depicting the immersion of a third edge of a sound absorbing member into the water resistant curable polymeric material.

FIG. 8 illustrates a third step of making the improved sound reducing panel 10 depicting the immersion of the third edge 43 of a sound absorbing member 30 into the water resistant curable polymeric material 50 to form the third frame portion 63A of the internal frame 60A.

Figure 9:
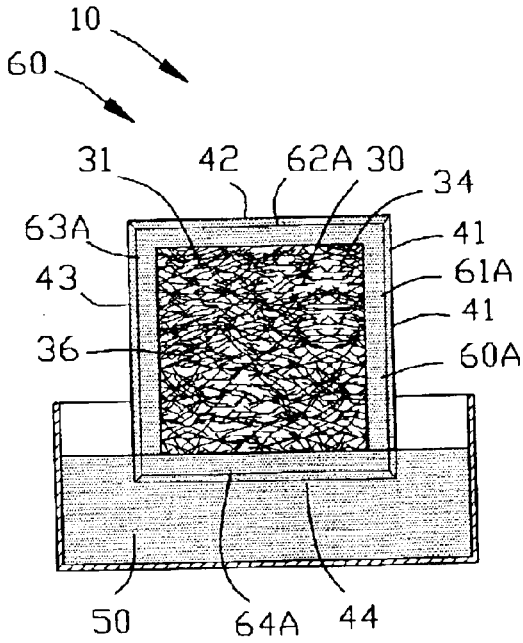
FIG. 9 illustrates a fourth step of making the first embodiment of the improved sound reducing panel of FIGS. 1 and 2 depicting the immersion of a fourth edge of a sound absorbing member into the water resistant curable polymeric material to complete the internal frame.

FIG. 9 illustrates a fourth step of making the improved sound reducing panel 10 depicting the immersion of the fourth edge 44 of a sound absorbing member 30 into the water resistant curable polymeric material 50 to form the fourth frame portion 64A of the internal frame 60A.

Figure 10:
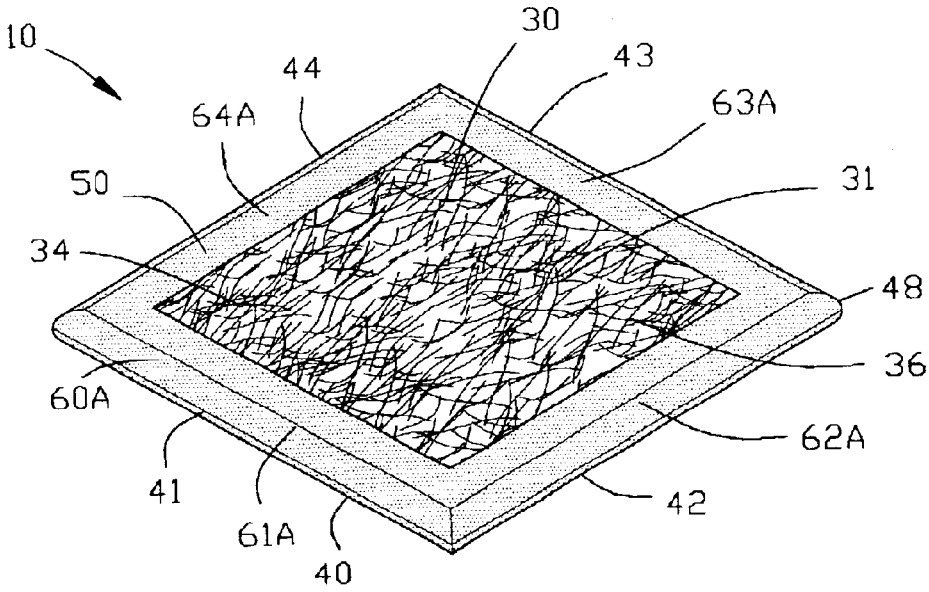
FIG. 10 is a top isometric view of the water resistant sound absorbing member with the internal frame formed from the impregnated water resistant curable polymeric material.
Figure 11:
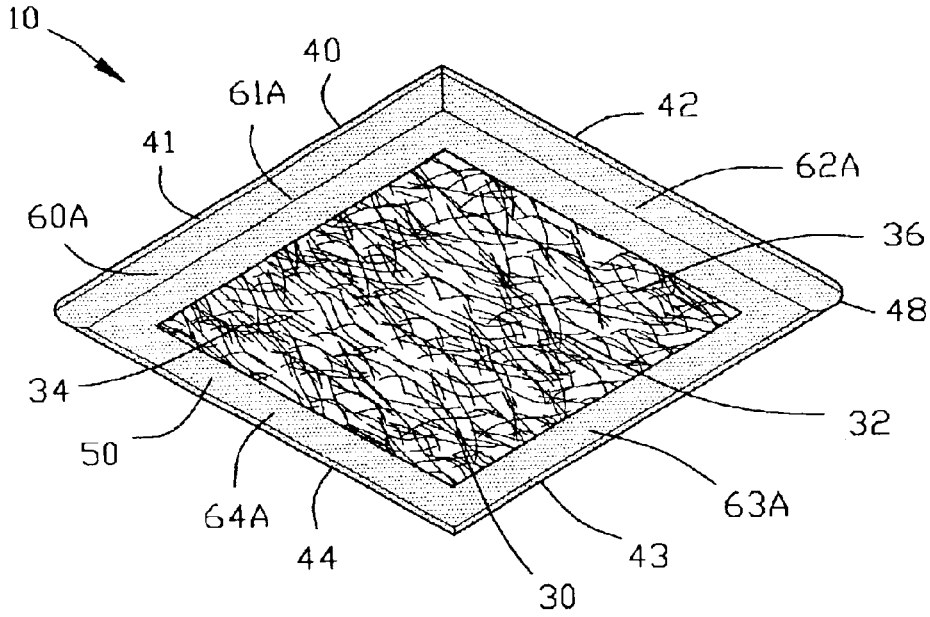
FIG. 11 is a bottom isometric view of FIG. 10.

FIGS. 10 and 11 are top and bottom isometric views of the water resistant sound absorbing member 30 with the completed internal frame 60A formed from the impregnated water resistant curable polymeric material 50. In this example of the invention, the water resistant sound absorbing member 30 comprises a substantially rigid sheet of sound absorbing material. In the alternative, the water resistant sound absorbing member 30 may comprise a substantially flexible sheet of sound absorbing material with the completed internal frame 60A supplying the necessary rigidity to the water resistant sound absorbing member 30.

Figure 12:
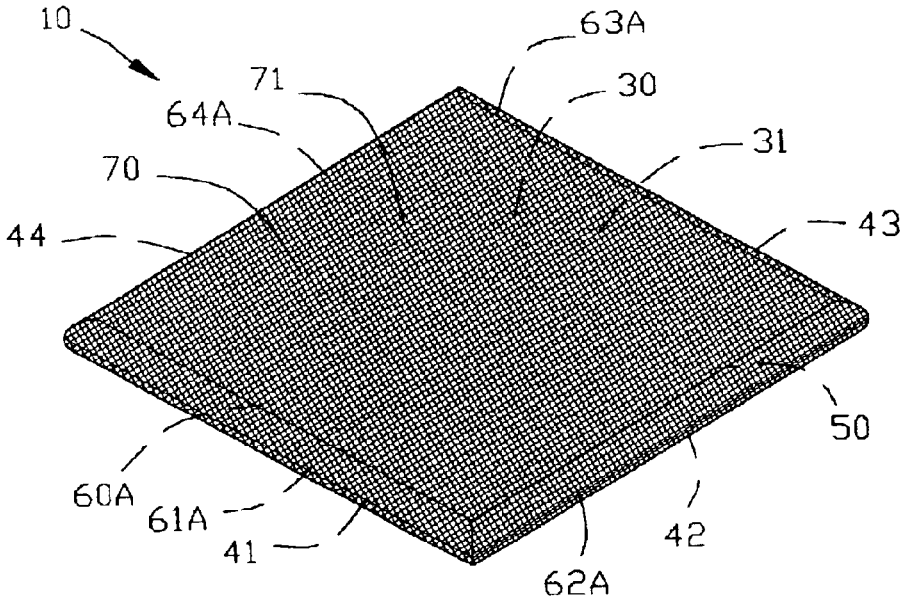
FIG. 12 is view similar to FIG. 10 illustrating a fifth step of making the first embodiment of the improved sound reducing panel depicting a first face of the sound absorbing member being overlaid with a first covering sheet.
Figure 13:
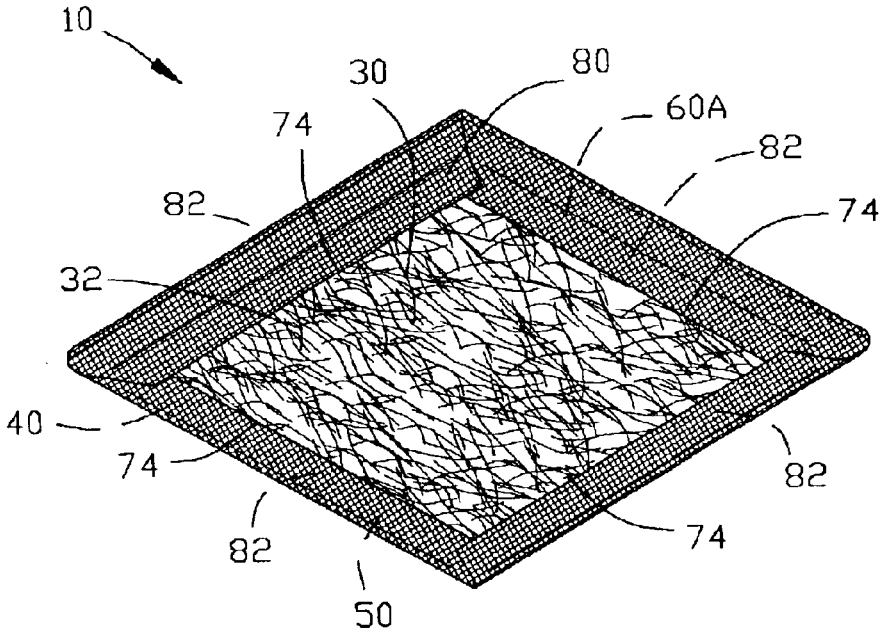
FIG. 13 is a bottom isometric view of FIG. 12.
Figure 14:
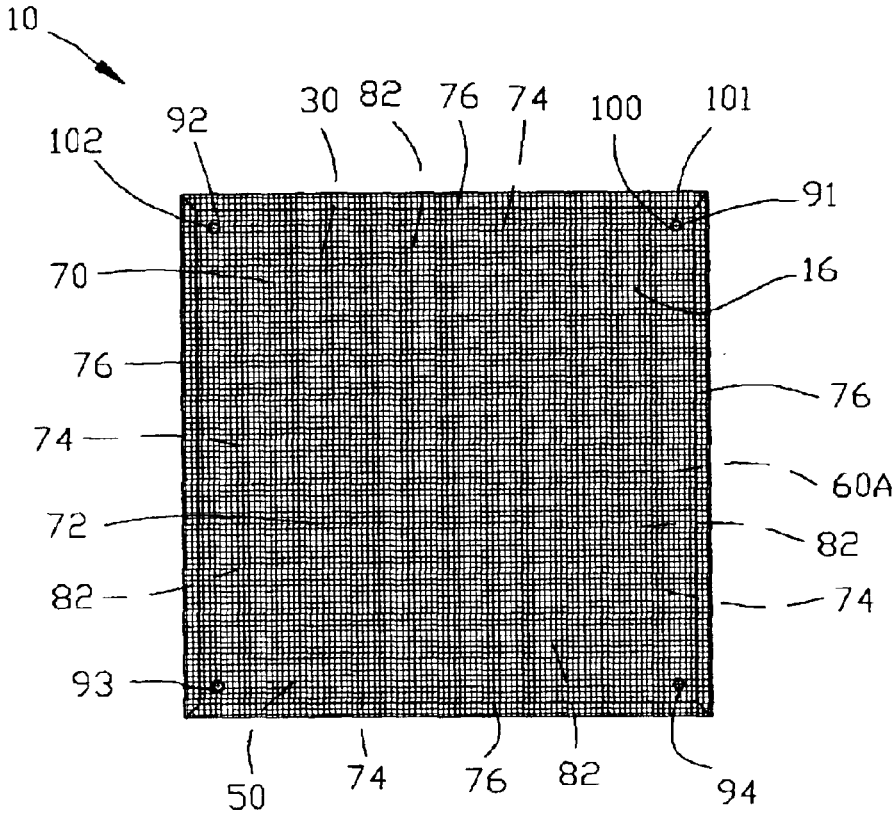
FIG. 14 is a bottom view of FIG. 13 illustrating a sixth step to making the first embodiment of the improved sound reducing panel depicting a second face of the sound absorbing member being overlaid with a second covering sheet.

FIGS. 12–14 illustrate further steps in the process of making the improved sound reducing panel 10 of the present invention. The improved sound reducing panel 10 comprises a porous covering sheet 70 for overlaying the first and second face surfaces 31 and 32 of the sound absorbing member 30. In this example, the porous covering sheet 70 comprises a first and a second covering sheet 71 and 72 for overlaying the first and second face surfaces 31 and 32 of the sound absorbing member 30.

FIG. 12 is view similar to FIG. 10 illustrating a fifth step of making the improved sound reducing panel 10 depicting the first face 31 of the sound absorbing member 30 being overlaid with the first covering sheet 71.

FIG. 13 is a bottom isometric view of FIG. 12 illustrating the peripheral edges 74 of the first covering sheet 71 being attached to the second face surface 32 of the sound absorbing member 30. In this example, a peripheral edge 74 of the first covering sheet 71 is attached to the second face 32 of the sound absorbing member 30 by an adhesive 82.

FIG. 14 is a bottom view of FIG. 13 illustrating a sixth step of making the improved sound reducing panel 10 depicting a second face 32 of the sound absorbing member 30 being overlaid with the second covering sheet 72. In this example, a peripheral edge 76 of the second covering sheet 72 is attached to the peripheral edge 74 of the first covering sheet 71 by the adhesive 82.

In this example, the porous covering sheet 70 is a porous covering sheet made of a liquid resistant substantially flexible fabric material. Preferably, the porous covering sheet 70 is formed from a synthetic fabric material. In one example of the invention, the porous covering sheet 70 comprises a polyester textile material.

Figure 15:
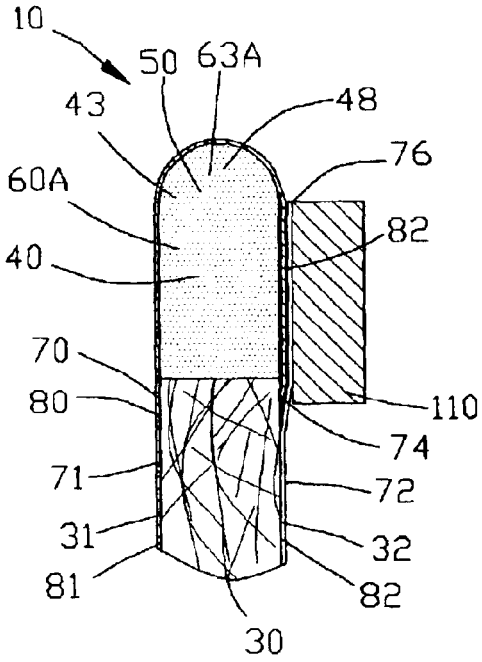
FIG. 15 is an enlarged sectional view along line 15—15 in FIG. 1.

FIG. 15 is an enlarged sectional view along line I—I in FIG. 14 illustrating an attachment 80 for securing the porous covering sheet 70 to the water resistant sound absorbing member 30. In one example, the attachment 80 includes adhesive layers 80 for securing the flexible porous covering sheet 70 to the water resistant sound absorbing member 30. In this example, the adhesive layer 80 comprises a first and a second adhesive layer 81 and 82 for securing the first and second flexible porous covering sheet 71 and 72 to the water resistant sound absorbing member 30. Preferably, the adhesive layers 80 are formed from a water resistant adhesive for securing the flexible porous covering sheet 70 to the water resistant sound absorbing member 30.

Figure 16:
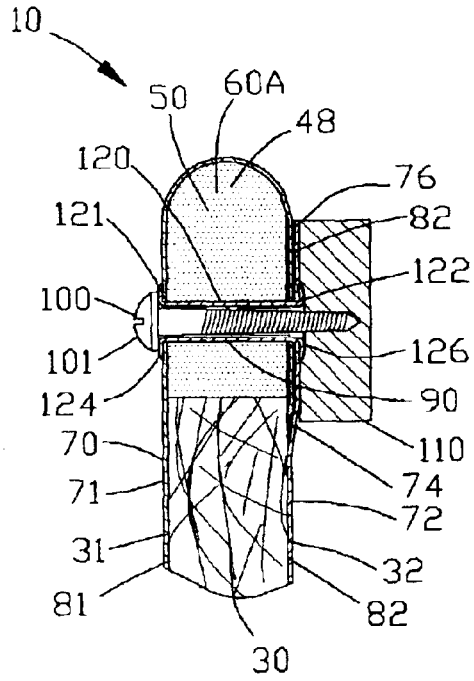
FIG. 16 is an enlarged sectional view along line 16—16 in FIG. 1.

FIG. 16 is an enlarged sectional view along line 16—16 in FIG. 1 illustrating the optional mounting 90 for supporting the improved sound reducing panel 10. In this example of the invention, the mounting 90 includes first through fourth bores 91–94 extending through the first through fourth frame portion 61A–64A of the internal frame 60A. The first through fourth bores 91–94 further extend through the first and second covering sheets 71 and 72 overlaying the first and second face surfaces 31 and 32 of the sound absorbing member 30. The internal frame 60A provides the necessary support for enabling a fastener 100 to extend through the bore 91 for mounting the improved sound reducing panel 10 to a support 110.

The fastener 100 extends through the bore 90 for mounting the improved sound reducing panel 10 to the support 110. In this example of the invention, a fastener 100 comprises a plurality of fasteners 101–104 extending through the plurality of bores 91–94 for mounting the improved sound reducing panel 10 to the support 110. The plurality of fasteners 101–104 may be mechanical fasteners of such as screws, bolts, nails or the like. In the alternative, the plurality of fasteners 100 and may be rope, wire or other types of fastening devices.

In this example, each of the mountings 90 includes a metallic sleeve 120 extending between a first and a second end 121 and 122. The metallic sleeve 120 is shown inserted within the first bore 91 to extend through the third frame portion 63A of the internal frame 60A. The first and second ends 121 and 122 of the metallic sleeve 120 includes flares 124 and 126 for engaging the first and second face surfaces 31 and 32 of the sound absorbing member 30 through the first and the second covering sheets 71 and 72. The metallic sleeve 120 adds mechanical strength to the first bore 91 extending through the third frame portion 63A of the internal frame 60A.

Figure 17:
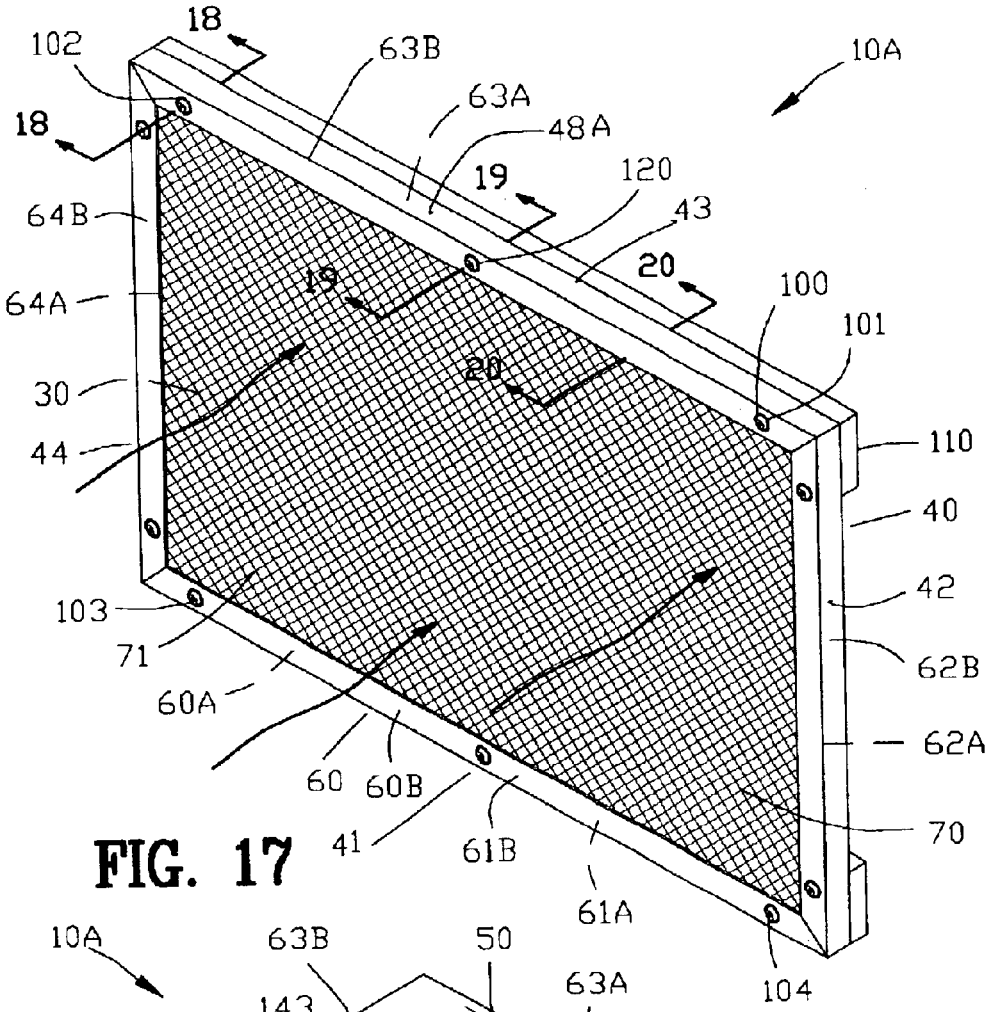
FIG. 17 is an isometric view of a second embodiment of an improved sound reducing panel of the present invention installed on a support in an outdoor or a hazardous environment.
Figure 18:
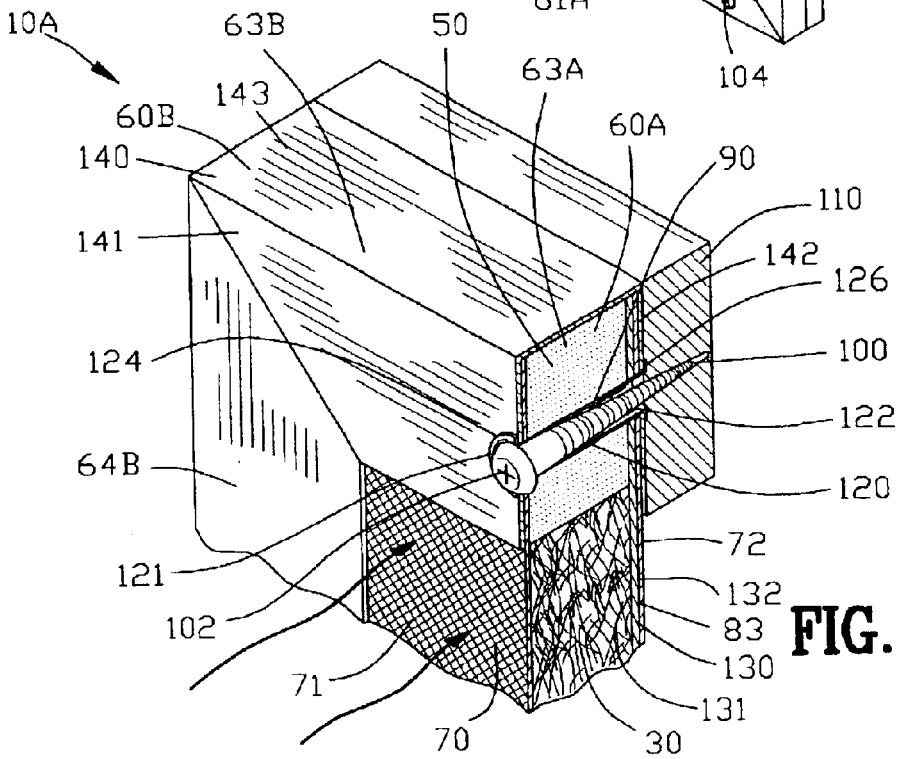
FIG. 18 is an enlarged isometric view along line 18—18 in FIG. 17.

FIGS. 17 and 18 are isometric views of a second embodiment of an improved sound reducing panel 10A of the present invention installed on a support 110 in an outdoor or a hazardous environment. In this example the water resistant sound absorbing member 30 comprises a plurality of peripheral edges 40 shown as peripheral edges 41–44 in a rectangular configuration. In this second embodiment of the invention, each of the plurality of peripheral edge 41–44 has a substantially rectangular cross-section 48A.

In this second embodiment of the invention, the support frame 60 of the improved sound reducing panel 11A includes an internal frame 60A and an external frame 60B. The internal frame 60A includes a water resistant curable polymeric material 50 impregnated into a portion of each of the plurality of peripheral edges 41–44 of the sound absorbing member 30. The internal frame 60A may be formed in a manner similar to the internal frame 60 shown in FIGS. 1–16.

The external frame 60B is located about the plurality of peripheral edges surfaces 41–44 of the sound absorbing member 30. The external frame 60B includes a rigid material overlying a portion of each of the plurality of peripheral edges 41–44 of the sound absorbing member 30. The external frame 60B overlies the plurality of peripheral edges 41–44 and overlies the internal frame 60A of the sound absorbing member.

The improved sound reducing panel 10A includes a water resistant sound blocking member 130 for blocking the transmission of sound through the sound reducing panel. The water resistant sound blocking member 130 comprises a first and a second face surface 131 and 132. The water resistant sound blocking member 130 is affixed to the water resistant sound absorbing member 30. Preferably, the water resistant sound blocking member 130 is affixed to the second face surface 132 of the water resistant sound absorbing member 30 by a third adhesive layer 83.

Figure 19:
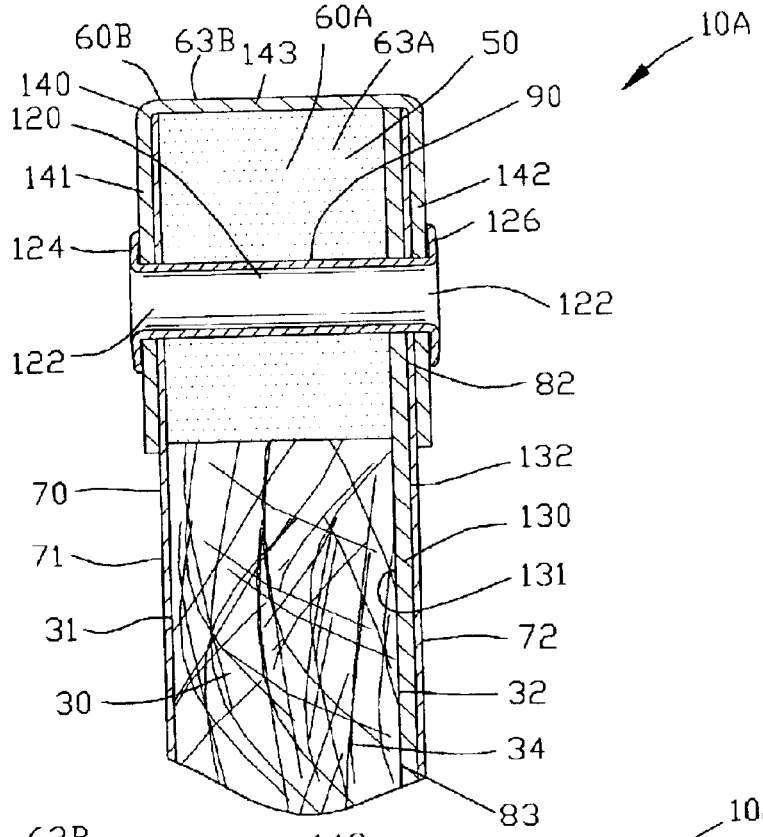
FIG. 19 is an enlarged sectional view along line 19—19 in FIG. 17 with the support being removed.
Figure 20:
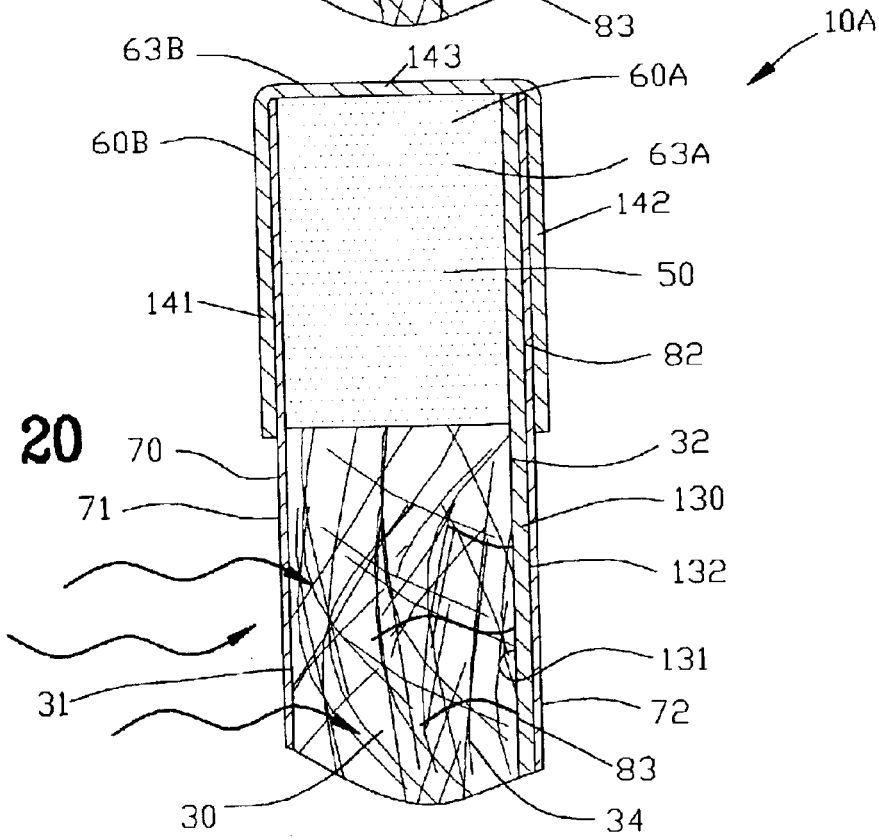
FIG. 20 is an enlarged sectional view along line 20—20 in FIG. 17 with the support being removed.

FIGS. 19 and 20 are enlarged sectional views of the sound reducing panel 10A of FIG. 17 with the support 110 being removed for the purposes of clarity. The external frame 60B is shown as a generally U-shape metallic member 140 located about the plurality of peripheral edges surfaces 41–44 of the sound absorbing member 30. The U-shape metallic member 140 includes a first and a second leg 141 and 142 connected by an intermediate leg 143.

The first and second legs 141 and 142 are disposed adjacent to the first and second face surfaces 31 and 32 of the water resistant sound absorbing member 30. The intermediate leg 143 of the U-shape metallic member 140 is located adjacent to a respective side of the plurality of peripheral edges surfaces 41–44 of the sound absorbing member 30. The external frame 60B maybe secured to the water resistant sound absorbing member 30 by securing the frame sections 61A–64A to one another by suitable means such as mechanical fasteners, welding or any other suitable means.

The first face surface 131 of the water resistant sound blocking member 130 is affixed to the second face surface 32 of the water resistant sound absorbing member 30. The water resistant sound blocking member 130 acts in concert with the water resistant sound absorbing member 30. The water resistant sound absorbing member 30 enables sound entering the first face surface 31 of the sound absorbing member 30 to be absorbed and/or dissipated by the sound absorbing member 30. The water resistant sound blocking member 130 inhibits sound from exiting from the second face surface 32 of the sound absorbing member 30. The water resistant sound blocking member 130 inhibits sound from passing through the sound reducing panel 10A.

In this example, the water resistant sound blocking member 130 comprises a sheet of mineral filled vinyl polymeric material having a thickness of approximately one-eighth of an inch and having a weight equal to or greater than one pound per square foot. Preferably, the water resistant sound blocking member 130, which is a loaded mass vinyl has a sound transmission coefficient greater than 25. A suitable material is sold under the Registered Trademark Acoustiblok by Acoustiblok, Inc. of Tampa, Fla. (www.acoustiblok.com).

Figure 21:
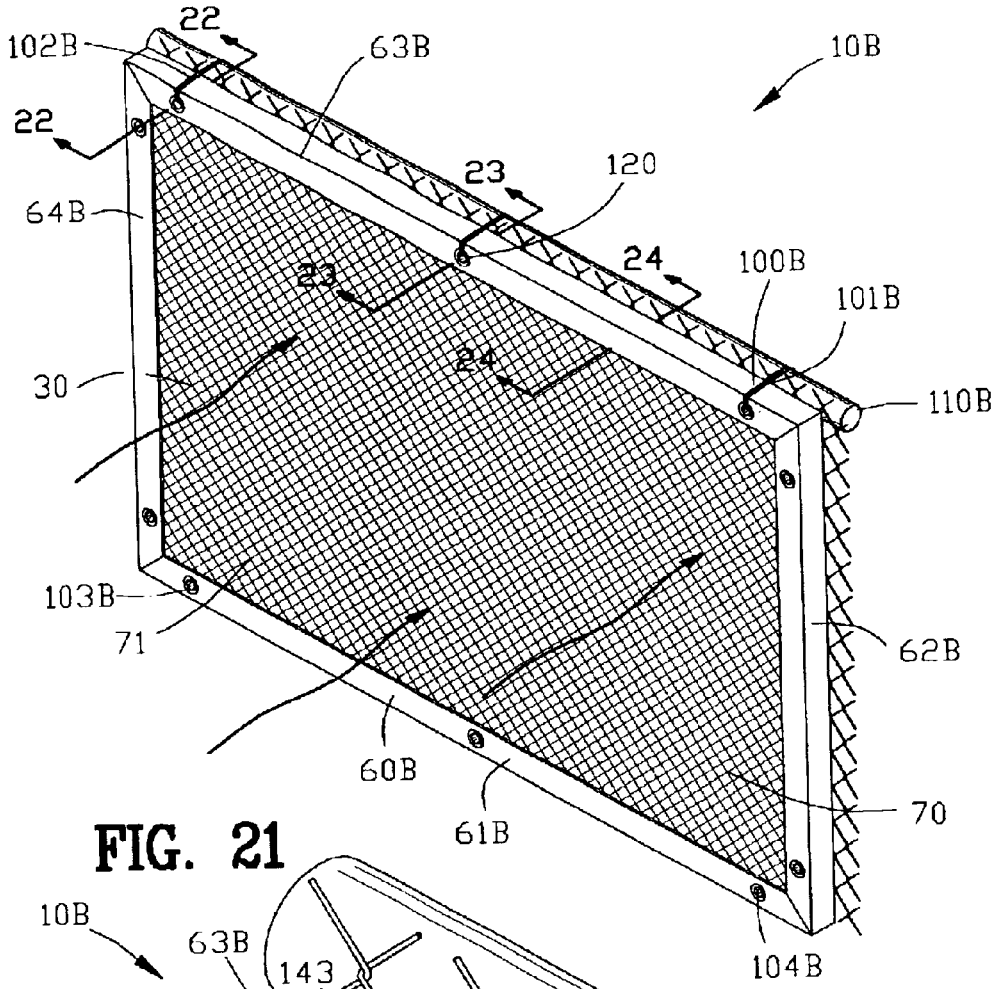
FIG. 21 is an isometric view of a third embodiment of an improved sound reducing panel of the present invention installed on a support in an outdoor or a hazardous environment.
Figure 22:
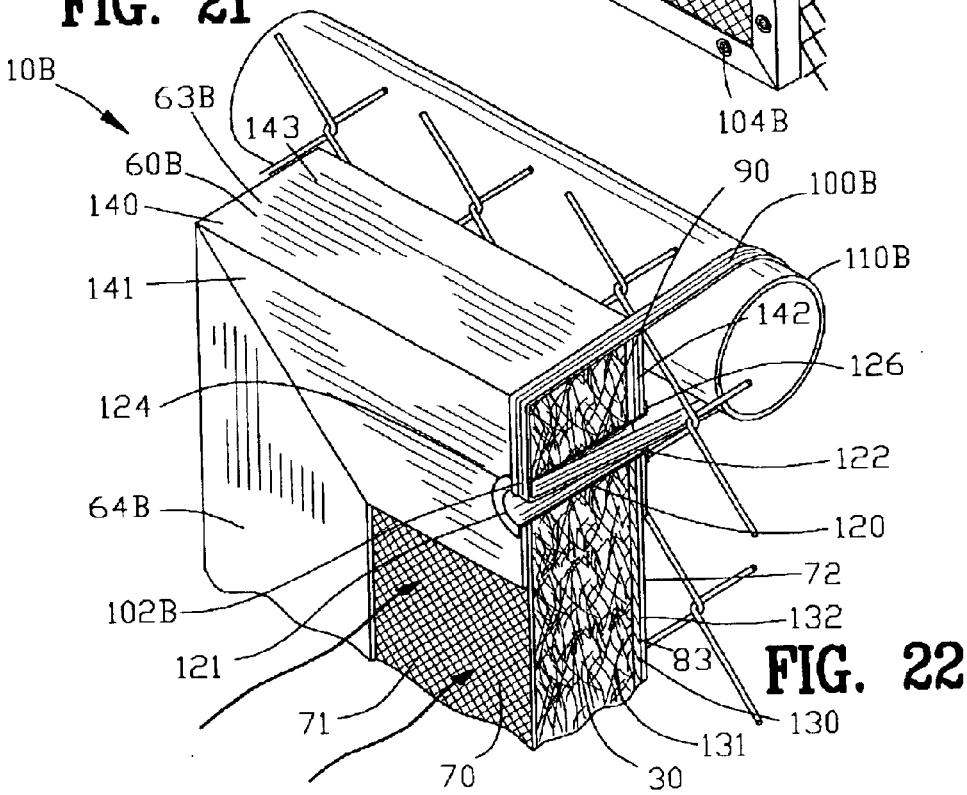
FIG. 22 is an enlarged isometric view along line 22—22 in FIG. 21.

FIGS. 21 and 22 are isometric views of a third embodiment of an improved sound reducing panel 10B of the present invention installed on a support 110B in an outdoor or a hazardous environment. In this example, the support 110B is shown as a chain link fence of conventional design. The mounting fasteners 100B are shown as wire, fiber or plastic fasteners for securing the improved sound reducing panel 10B to the support 110B. Although the support 110B has been shown as a chain link fence of conventional design, it should be appreciated that numerous other ways and methods may be used for supporting and or hanging or otherwise spending the improved sound reducing panel with them and environment.

Figure 23:
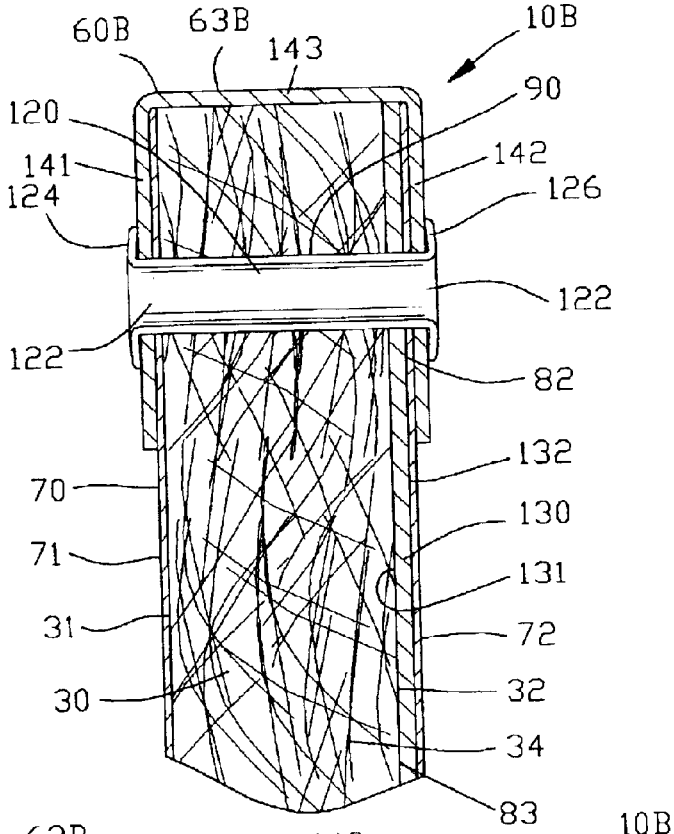
FIG. 23 is an enlarged sectional view along line 23—23 in FIG. 21 with the support being removed.
Figure 24:
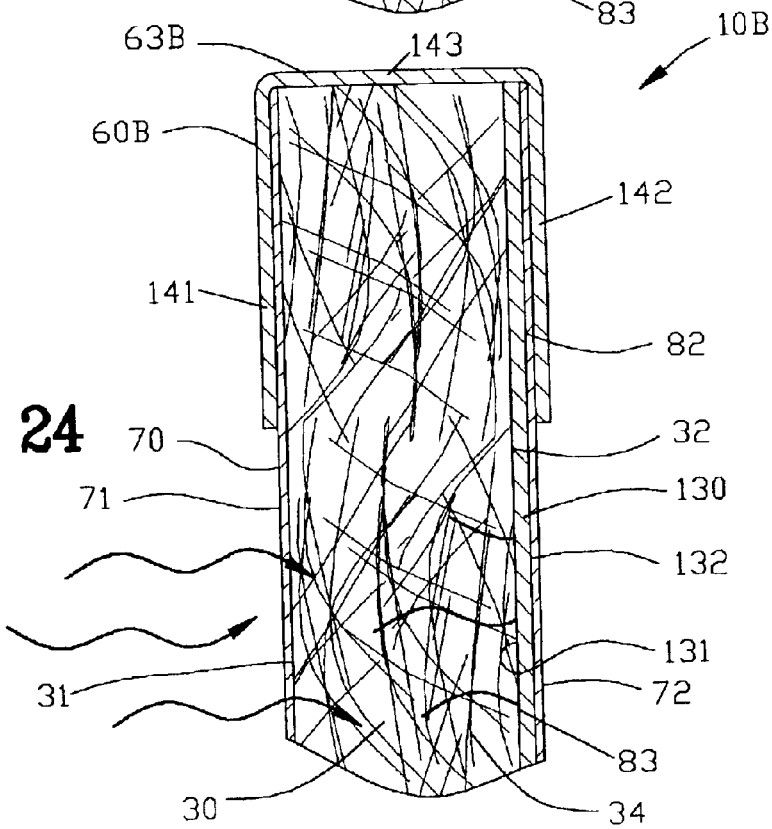
FIG. 24 is an enlarged sectional view along line 24—24 in FIG. 21 with the support being removed.

FIGS. 23 and 24 are enlarged sectional views of the sound reducing panel 10B of FIG. 21 with the support 110B being removed for the purposes of clarity. In this third embodiment of the invention, the support frame 60 of the improved sound reducing panel 1013 includes an external frame 60B. The improved sound reducing panel 10B has no internal frame. The external frame 60B is located about the plurality of peripheral edges surfaces 41–44 of the sound absorbing member 30. The external frame 60B includes a rigid material overlying a portion of each of the plurality of peripheral edges 41–44 of the sound absorbing member 30.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An improved sound reducing panel suitable for use in an outdoor or a hazardous environment, comprising:

a water resistant sound absorbing member defined by a first and second face surface and a plurality of peripheral edges;

a water resistant sound blocking member defined by a first and second face surface and a plurality of peripheral edges;

said second face surface of said sound blocking member being adhesively secured to said second face surface of said sound absorbing member for blocking the transmission of sound through the sound reducing panel;

said water resistant sound blocking member comprising a sheet of polymeric material having a thickness of approximately one-eighth of an inch and having a weight equal to or greater than one pound per square foot;

said water resistant sound blocking member having a sound transmission coefficient greater than 25;

a support frame comprising an inner frame and an external frame;

said inner frame including a water resistant curable polymeric material impregnated into a portion of each of said plurality of peripheral edges of said sound absorbing member;

said external frame including a rigid metallic material overlying a portion of each of said plurality of peripheral edges of said sound absorbing member a porous covering sheet overlaying said sound absorbing member and said sound blocking member;

an attachment for securing said porous covering sheet to said sound absorbing member; and a mounting for supporting the improved sound-reducing panel.

2. An improved sound reducing panel suitable for use in an outdoor or a hazardous environment, comprising:

a water resistant sound absorbing member defined by a first and second face surface and a plurality of peripheral edges;

a water resistant sound blocking member affixed to said water resistant sound absorbing member for blocking the transmission of sound through the sound reducing panel;

said water resistant sound blocking member being affixed to said second face surface of said water resistant sound absorbing member by an adhesive layer;

said water resistant sound blocking member comprising a sheet of mineral filled polymeric material having a weight equal to or greater than one pound per square foot;

a porous covering sheet overlaying said first and second face surfaces of said sound absorbing member and said water resistant sound blocking member;

a support frame located about said plurality of peripheral edges of said sound absorbing member; and a mounting for supporting the improved sound reducing panel.

3. An improved sound reducing panel suitable for use in an outdoor or a hazardous environment, comprising:

a water resistant sound absorbing member defined by a first and second face surface and a plurality of peripheral edges;

a water resistant sound blocking member adhesively secured to said second face surface of said sound absorbing member for blocking the transmission of sound through the sound reducing panel;

said water resistant sound blocking member comprising a sheet of polymeric material having a thickness of approximately one-eighth of an inch and having a weight equal to or greater than one pound per square foot;

said water resistant sound blocking member having a sound transmission coefficient greater than 25;

a porous covering sheet overlaying said sound absorbing member and said sound blocking member;

a support frame located about said plurality of peripheral edges of said sound absorbing member; and a mounting for supporting the improved sound reducing panel.

4. An improved sound reducing panel suitable for use in an outdoor or a hazardous environment, comprising:

a water resistant sound absorbing member defined by a first and second face surface and a plurality of peripheral edges;

a water resistant sound blocking member secured to said second face surface of said sound absorbing member for blocking the transmission of sound through the sound reducing panel;

said water resistant sound blocking member comprising a sheet of polymeric material having a thickness of approximately one-eighth of an inch and having a weight equal to or greater than one pound per square foot;

a porous covering sheet overlaying said sound absorbing member and said sound blocking member;

a support frame located about said plurality of peripheral edges of said sound absorbing member and said sound blocking member; and a mounting for supporting the improved sound reducing panel.

5. An improved sound reducing panel suitable for use in an outdoor or a hazardous environment, comprising:

a water resistant sound absorbing member defined by a first and second face surface and a plurality of peripheral edges;

a water resistant sound blocking member secured to said second face surface of said sound absorbing member for blocking the transmission of sound through the sound reducing panel;

said water resistant sound blocking member comprising a sheet of polymeric material having a weight equal to or greater than one pound per square foot;

a porous covering sheet overlaying said sound absorbing member and said sound blocking member;

a support frame located about said plurality of peripheral edges of said sound absorbing member and said sound blocking member; and a mounting for supporting the improved sound reducing panel.

* * * * *